US005111598A

United States Patent [19]

Sartor et al.

[11] Patent Number: 5,111,598

[45] Date of Patent: May 12, 1992

[54] SKI BOOT WITH MIXED FRONT ENTRY AND REAR ENTRY STRUCTURE

[75] Inventors: Mariano Sartor, Montebelluna; Valerio Tonel, Biadene, both of Italy

[73] Assignee: Nordica S.p.A., Montebelluna, Italy

[21] Appl. No.: 652,695

[22] Filed: Feb. 8, 1991

[30] Foreign Application Priority Data

Feb. 16, 1990 [IT] Italy ..... 82523 A/90

[51] Int. Cl.[5] ..... A43B 5/04

[52] U.S. Cl. ..... 36/117; 36/121

[58] Field of Search ..... 36/117, 118, 119, 120, 36/121

[56] References Cited

U.S. PATENT DOCUMENTS

| | | | |
|---|---|---|---|
| 3,561,139 | 2/1971 | Stillman | 36/119 |
| 4,577,421 | 3/1986 | Sartor | 36/117 |
| 4,691,454 | 9/1987 | Ottieri | 36/117 |
| 4,825,566 | 5/1989 | Sartor | 36/117 |
| 5,003,710 | 4/1991 | Pozzobon | 36/117 |

FOREIGN PATENT DOCUMENTS

| | | | |
|---|---|---|---|
| 0240981 | 10/1987 | European Pat. Off. | 36/117 |

*Primary Examiner*—Paul T. Sewell
*Assistant Examiner*—Marie D. Patterson
*Attorney, Agent, or Firm*—Guido Modiano; Albert Josif

[57] ABSTRACT

A ski boot of the type having a shell with overlapping flaps or of the rigid monolithic type, with at least one closure point on the instep and/or on the metatarsal region and a front quarter and a rear quarter associated with the shell. A band-like element is associated with the front quarter. The front quarter has one or more partially mutually superimposed tabs inside which there is at least one tongue which protrudes from the band-like element. The band-like element, which interacts with tension-producing devices, has rivets engaging respective slots in the front quarter.

10 Claims, 2 Drawing Sheets

SKI BOOT WITH MIXED FRONT ENTRY AND REAR ENTRY STRUCTURE

BACKGROUND OF THE INVENTION

The present invention relates to a ski boot with mixed front entry and rear entry.

Known ski boots currently have essentially three types of design. A ski boot of the rear-entry type is constituted by a monolithic rigid shell with which a front quarter and a 5 rear quarter are associated; the rear quarter can be tilted down to allow the easy insertion of the foot from the rear.

A boot of the front-entry type has a shell with overlapping flaps with which a single quarter is associated; the quarter has front tabs which can partially overlap and interact with closure means such as levers. Finally, a boot of the mixed-structure type comprises a shell with overlapping flaps with which a front quarter and a rear quarter are associated.

This last type of design is currently the most interesting, since attempts are made to combine in said structure the advantages typical of front entry, i.e. the optimum embracing of the foot, with those of rear entry, i.e. better comfort.

This solution is so far not yet optimum in known boots.

Another disadvantage observed in said known types of ski boot consists of the fact that they require, for the closure of the front quarter, conventional levers which are structurally complex, not easily manufactured industrially, and add considerable weight to the boot.

The front quarter is furthermore subjected to deformations during sking in said known types of boot.

SUMMARY OF THE INVENTION

The aim of the present invention is therefore to eliminate the disadvantages described above in known types by providing a ski boot of the mixed type in which it is possible to bring close together and secure the flaps of the front quarter in a rapid and simple manner, eliminating the use of conventional closure levers which are structurally complicated and have high manufacturing costs.

An object of the invention is also to ensure an optimum embracing of the leg for a better control of the ski.

Within the scope of the above descibed aim, another important object is to provide a ski boot in which the front quarter has a compact structure in which the tabs of the flaps are effectively prevented from sliding one over the other when flexing the legs while skiing.

Still another important object is to provide a ski boot which has a reduced number of components and is easy to industrialize.

Not least object is to provide a ski boot which associates with the preceding characteristic that of being economical as well as reliable and safe in use.

This aim, these ojects and others which will become apparent hereinafter are achieved by a ski boot, comprising a shell of the type with overlapping flaps or of the rigid monolithic type, with at least one closure point on the instep and/or on the metatarsal region and a front quarter and a rear quarter associated with said shell, characterized in that said front quarter has one or more tabs which are at least partially mutually superimposed, at least one band-like element being associated with said front quarter, said band-like element interacting with tension-producing devices and having at least one tongue arranged below said one or more tabs.

Said tongue preferably has a means for engaging said one or more tabs.

BRIEF DESCRIPTION OF THE DRAWINGS

Further characteristics and advantages of the invention will become apparent from the dtailed description of a particular but not exclusive embodiment, illustrated only by way of non-limitative example in the accompanying drawings, wherein.

DESCRIPTION OF THE PREFERRED EMBODIMENTS

Figures 1, 2, 3, 4:
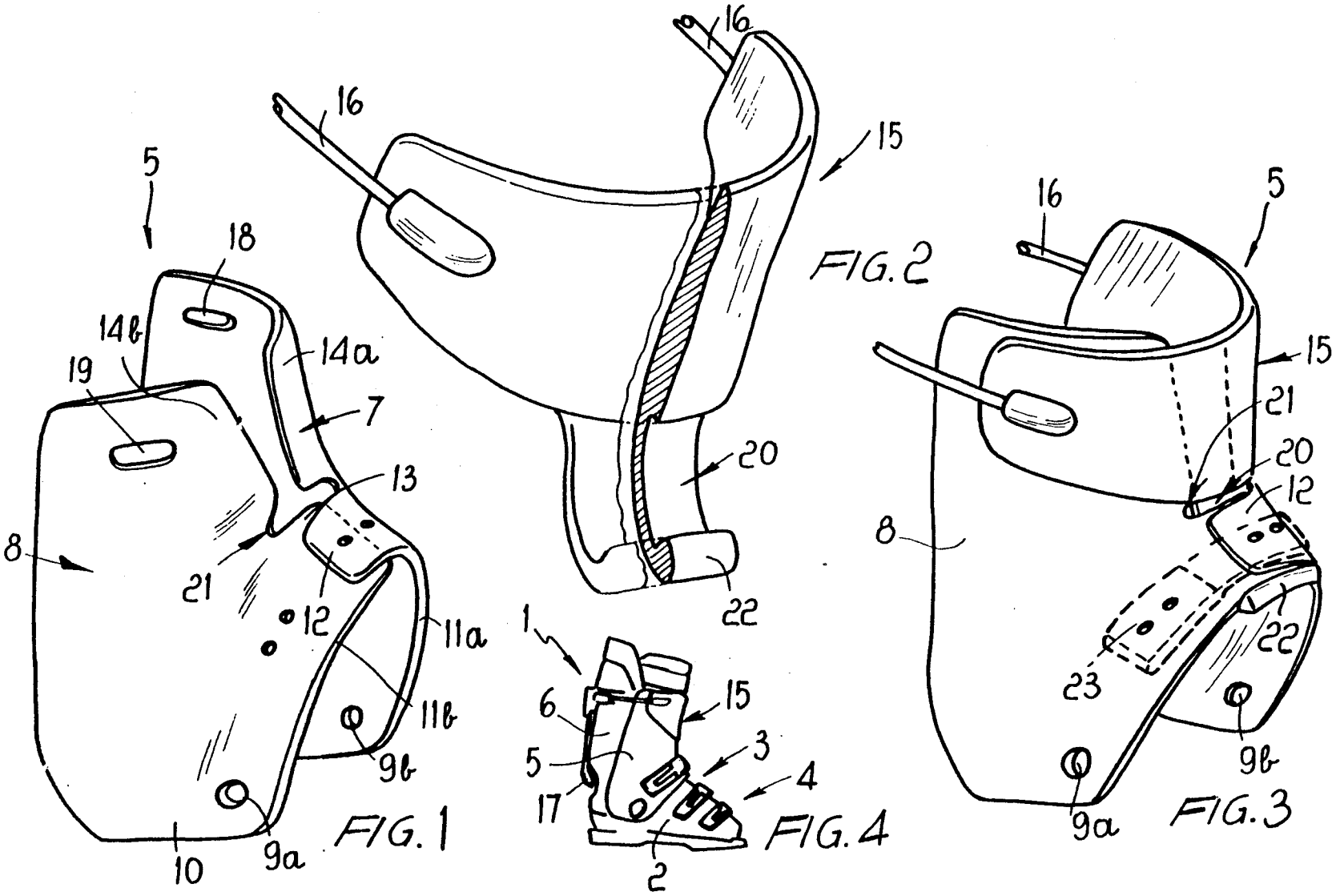
FIG. 1 is a perspective view of the front quarter.
FIG. 2 is a partially sectional view, similar to the preceding one, of the band-like element with the tongue.
FIG. 3 is a view of the front quarter associated with the band-like element.
FIG. 4 is a side view of the ski boot according to the invention.

With reference to the above figures, the ski boot, generally indicated by the reference numeral 1, comprises a shell 2 of the type with overlapping flaps or of the ridid monolithic type, which comprises a closure point at the foot instep region 3 and/or a second closure point at the metatarsal region 4, said closure occurring for example by means of adapted known levers arranged transversely to said shell or by means of pressers and/or cables if a rigid monolithic shell is used.

The structure 1 furthermore comprises a front quarter 5 and a rear quarter 6 which are associated with the shell 2.

The front quarter 5 is preferably constituted by a first lateral element 7 and by a second lateral element 8 which are laterally associated with the shell 2 at opposite sides of the boot for example by means of adapted rivets which pass at adapted holes 9*a* and 9*b* defined proximate to the lower perimetric edge 10.

Both said first element and said second element have, at the front perimetric edge 11*a* and 11*b*, respectively a first tab 12 and a second tab 13.

Said first tab and said second tab are arranged mutually parallel, are at least partially superimposed approximately at the median region of the front quarter 5, and are mutually secured thereat by virtue of adapted means such as for example a lever 23.

This arrangement of said first tab and of said second tab causes the flaps 14*a* and 14*b* of said first element and of said second element to arrange themselves mutually face to face.

The ski boot furthermore constituted by at least one band-like element 15 which is arranged externally to said first element and to said second element and at least partially embraces them and covers the region of the flaps 14*a* and 14*b*.

The ends of at least one cable 16 are associated with the lateral ends of said band-like element, and said cable can be put under tension by virtue of adapted tension-producing means 17, such as a lever, which can be associated for example preferably at the rear quarter 6.

The band-like element 15 can be connected laterally to the first element and to the second element for example by means of adapted rivets which can slide at a first slot 18 and at a second slot 19, formed respectively on said first element 7 and on said second element 8, as it will be discussed later.

The band-like element 15 is furthermore provided, approximately as its own median axis, with a tongue 20 which protrudes therefrom and which, by means of an adapted opening 21 defined transversely to said first element and to said second element in a region adjacent to said first tab and to said second tab, is caused to pass below said tabs, as illustrated in FIG. 3.

The purpose of the tongue 20 is to effectively retain the band-like element, providing a third point for locking it in addition to the two points provided by the two lateral rivets.

An engagement means can be provided at the terminal end of said tongue 20 and is constituted by a raised portion 22 which abuts at the perimetric front edges 11*a* and 11*b* of said first tab and of said second tab.

The purpose of the raised portion 22 provided at the end of the tongue 20 is to lock the mutual sliding of the first tab and of the second tab during the oscillation steps of the front quarter. The raised portion 22 may be provided to give greater compactness thereto.

The band-like element furthermore allows to bring close and secure the flaps 14*a* and 14*b* of the front quarter 5 by means for applying a longitudinal traction to said band-like element, constituted by the cable 16 and the lever 17, which leads to a pressure on the flaps to be secured.

This allows to eliminate the conventional closure levers with a very simple and economical device which also has a reduced weight.

It has thus been observed that the invention has achieved the intended aim and objects, a structure of ski boot having been provided which allows to bring close and secure the flaps of the front quarter by means of the use of cables and tension-producing devices for the band-like element which are constructively very simple and economical.

The use of the band-like element, together with the presence of the tongue, furthermore allows to make the front quarter very compact, since the band-like element is also locked along its median axis, preventing the swaying thereof during the opening of the boot; the mutual sliding of the first tab 12 and of the second tab 13 during the forward and backward flexing of the quarter is furthermore prevented.

The ski boot according to the invention is susceptible to numerous modifications and variations, all of which are within the scope of the same inventive concept.

Figures 5, 6, 7:
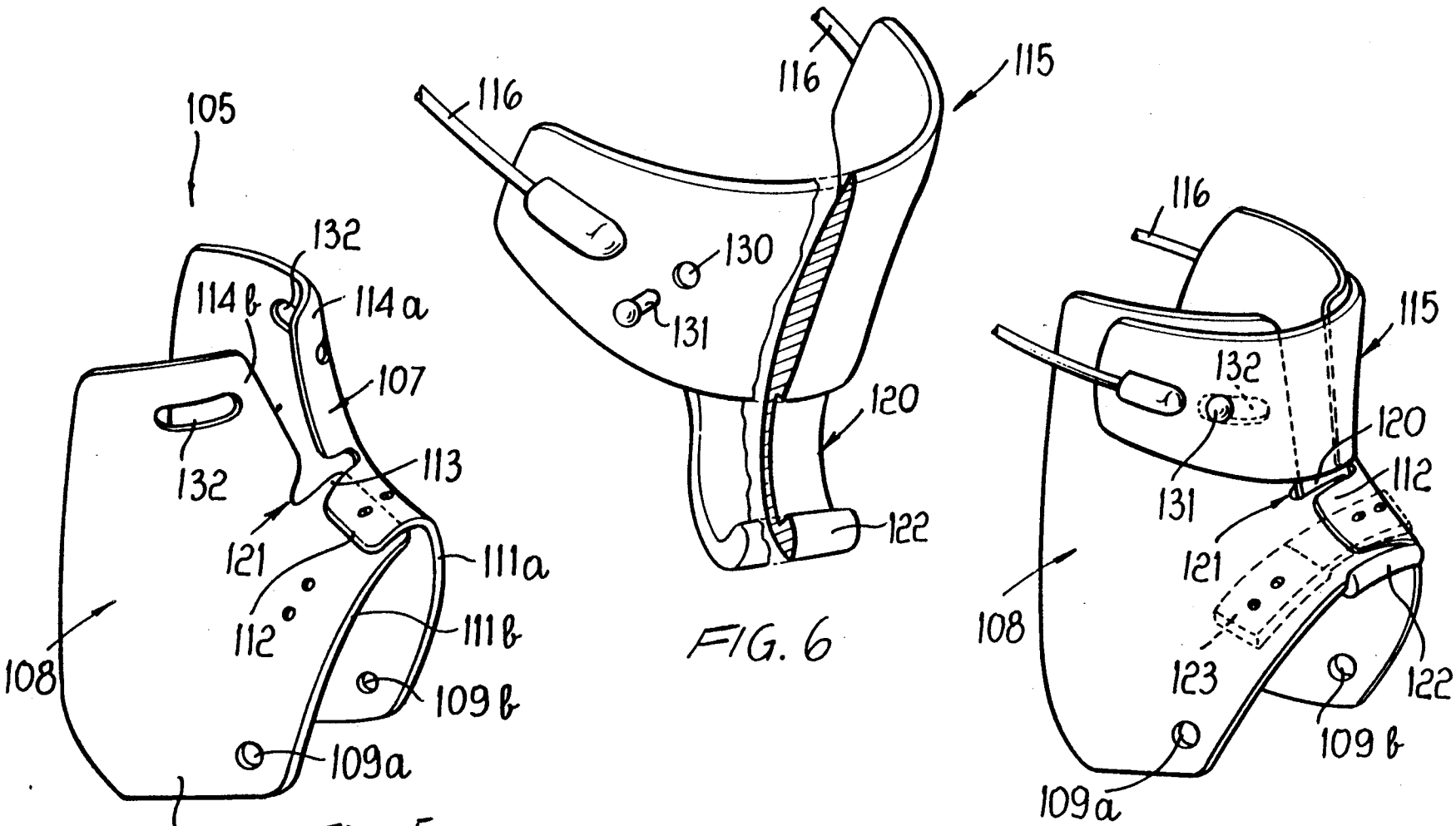
FIG. 5 is a front perspective view of the front quarter according to a second aspect of the invention.
FIG. 6 is a partially sectional perspective view of the band-like element according to the second aspect of the invention.
FIG. 7 is a front perspective view of the band-like element of FIG. 6 associated with the quarter of FIG. 5.

FIGS. 5–7, for example, illustrate a ski boot, according to a second aspect of the invention, wherein similar reference numbers, added of 100 with respect to the reference numerals of FIGS. 1–4, designate similar elements. In this case too, a band-like element 115 is arranged over the front quarter 105 in a manner substantially similar to what has been described above.

The band-like element 115, however, has a pair of holes 130; each hole 130 has a rivet 131; in the figures, only the right hand side hole and rivet are illustrated.

Each rivet 131 is adapted to slide in a corresponding slot 132 formed on each side of the front quarter, respectively on the first element 107 and on the second element 108.

The engagement between the rivets 131 and the slot 132 provide a limit stop for the sliding between the band-like element 115 and the front quarter 105.

The materials and dimensions which constitute the individual components of the structure may naturally be the most pertinent according to the specific requirements.

We claim:

1. Ski boot with mixed front entry and rear entry structure, comprising a shell, a front quarter and a rear quarter, said rear quarter being pivotally connected to said shell, said front quarter comprising a first lateral element and a second lateral element arranged at opposite sides of said ski boot, each of said first lateral element and said second lateral element having a lower portion connected to said shell and an upper portion, said upper portion of each of said first lateral portion and said second lateral portion defining a flap element, wherein said ski boot further comprises a band element arranged externally to each said upper portion of said first lateral element and said second lateral element, said band element being slidably engaged with said flap element of each of said first lateral portion and said second lateral portion of said front quarter, by being connected to the first and second elements at a location spaced below the flap elements said ski boot further comprising means for applying longitudinal traction to opposite lateral ends of said band element to thereby apply a closing pressure to each said flap element of said front quarter.

2. Ski boot according to claim 1, wherein said means for applying longitudinal traction to said opposite lateral ends of said band element comprise at least one cable and a lever, said lever being pivotally connected to said rear quarter, said at least one cable being interconnected between said lever and said opposite lateral ends of said band element.

3. Ski boot according to claim 1, wherein each said upper end of said first lateral element and said second lateral element is provided with a longitudinal slot in which a rivet element is slidably accommodated, said rivet element being rigidly connected to said band element.

4. Ski boot according to claim 1, wherein said shell is a rigid monolithic shell, said ski boot further comprising a foot instep presser element arranged inside said shell and means for applying pressure to said foot instep presser.

5. Ski boot according to claim 1, wherein said shell defines a foot instep region and a metatarsal region, said shell being provided with overlapping flaps arranged at said foot instep region and said metatarsal region, said ski boot further comprising at least one lever element for closing said overlapping flaps of said shell.

6. Ski boot with mixed front entry and rear entry structure, comprising a shell, a front quarter and a rear quarter, said rear quarter being pivotally connected to said shell, said front quarter comprising a first lateral element and a second lateral element arranged at opposite sides of said ski boot, each of said first lateral element and said second lateral element having a lower portion connected to said shell and an upper portion, said upper portion of each of said first lateral portion and said second lateral portion defining a flap element, wherein said ski boot further comprises a band element arranged externally to each said upper portion of said first lateral element and said second lateral element, said band element being slidably connected to said flap element of each of siad first lateral portion and said second lateral portion of said front quarter, said ski boot further comprising means for applying longitudinal traction to opposite lateral ends of said band element to thereby apply a closing pressure to each said flap element of said front quarter, said lateral element being provided with a first tab being arranged at the median region of the front quarter, said second lateral element being provided with a second tab being arranged at the median region of the front quarter, said ski boot further comprising a closure means interconnected between said first tab and said second tab.

7. Ski boot according to claim 6, wherein said closure means comprises a lever element.

8. Ski boot with mixed front entry and rear entry structure, comprising a shell, a front quarter and a rear quarter, said rear quarter being pivotally connected to said shell, said front quarter comprising a first lateral element and a second lateral element arranged at opposite sides of said ski boot, each of said first lateral element and said second lateral element having a lower portion connected to said shell and an upper portion, said upper portion of each of said first lateral portion and said second lateral portion defining a flap element, wherein said ski boot further comprises band element arranged externally to each said upper portion of said first lateral element and said second lateral element, said band element being slidably connected to said flap element of each of said first lateral portion and said second lateral portion of said front quarter, said ski boot further comprising means for applying longitudinal traction to opposite lateral ends of said band element to thereby apply a closing pressure to each said flap element of said front quarter, first lateral element being provided with a first tab being arranged at the median region of the front quarter, said second lateral element being provided with a second tab being arranged at the median region of the front quarter, said first tab and said second tab mutually overlapping at said median region of said front quarter, said ski boot further comprising a closure means interconnected between said first tab and said second tab, said band element further comprising a tongue element extending downwardly therefrom and being arranged under said overlapping first tab and second tab.

9. Ski boot according to claim 8, wherein said tongue extends through an opening which is defined transversely to said first lateral element and said second lateral element above said overlapping first tab and second tab.

10. Ski boot according to claim 8, wherein said overlapping first tab and second tab define respective front perimetric edges, said tongue element being provided at its end with a raised portion which abuts at said front perimetric edges of said overlapping first tab and second tab.

* * * * *